US006957951B2

(12) United States Patent
Ota et al.

(10) Patent No.: US 6,957,951 B2
(45) Date of Patent: Oct. 25, 2005

(54) CLOSED COMPRESSOR

(75) Inventors: Toshihiko Ota, Fujisawa (JP); Hidetoshi Nishihara, Fujisawa (JP); Akihiko Kubota, Chigasaki (JP); Masahiko Osaka, Chigasaki (JP); Manabu Motegi, Koshigaya (JP); Kazuhito Noguchi, Chigasaki (JP); Takeshi Kojima, Yokohama (JP)

(73) Assignee: Matsushita Refrigeration Company, Osaka (JP)

( * ) Notice: Subject to any disclaimer, the term of this patent is extended or adjusted under 35 U.S.C. 154(b) by 249 days.

(21) Appl. No.: 10/433,670

(22) PCT Filed: Dec. 20, 2001

(86) PCT No.: PCT/JP01/11197

§ 371 (c)(1),
(2), (4) Date: Jun. 5, 2003

(87) PCT Pub. No.: WO02/052152

PCT Pub. Date: Jul. 4, 2002

(65) Prior Publication Data

US 2004/0037712 A1 Feb. 26, 2004

(30) Foreign Application Priority Data

Dec. 25, 2000 (JP) ..... 2000-391958

(51) Int. Cl.[7] ..... F04B 39/00

(52) U.S. Cl. ..... 417/312; 181/229; 181/403

(58) Field of Search ..... 181/229, 403; 417/312

(56) References Cited

U.S. PATENT DOCUMENTS

| | | | | |
|---|---|---|---|---|
| 5,207,564 | A | 5/1993 | Fritchman, deceased | |
| 5,577,898 | A * | 11/1996 | Lee | 181/403 |
| 5,613,842 | A | 3/1997 | Alfano et al. | |
| 5,697,766 | A * | 12/1997 | Oh | 417/312 |
| 6,186,751 | B1 * | 2/2001 | Rigo | 181/403 |
| 6,305,912 | B1 * | 10/2001 | Svendsen et al. | 417/312 |
| 6,402,484 | B1 * | 6/2002 | Svendsen et al. | 417/312 |

FOREIGN PATENT DOCUMENTS

| | | |
|---|---|---|
| FR | 1430466 | 1/1966 |
| JP | 62-271974 | 11/1987 |
| WO | 98/22712 | 5/1998 |

* cited by examiner

*Primary Examiner*—Michael Koczo, Jr.
(74) *Attorney, Agent, or Firm*—Louis Woo

(57) ABSTRACT

In a hermetic compressor for use on an air-conditioning unit as well as a refrigerating unit such as a refrigerator and a showcase, there is disclosed a constitution designed to provide a silently operated hermetic compressor that has an intake muffler readily assembled thereon. The hermetic compressor including a substantially disk-like elastic member disposed between the intake muffler at an outlet thereof and a cylinder head is provided, in which an outlet orifice of the intake muffler constantly remains pressed against an intake valve port through a gasket.

5 Claims, 6 Drawing Sheets

CLOSED COMPRESSOR

TECHNICAL FIELD

This invention relates to a hermetic compressor used on a refrigerant cycle such as a refrigerator.

PRIOR ART

In recent years, a hermetic compressor designed to run silently has highly been required.

In conventional hermetic compressors, an irregularly deformed elastic means has been employed, which must be positioned within fine limits when an intake muffler is fixed to the compressor. One such example of a conventional hermetic compressor is disclosed in published Japanese Patent Application Laid-Open No. 62-271974.

The conventional hermetic compressor as discussed above will now be described with reference to the drawings. FIG. 7 is a longitudinal cross-sectional view, illustrating the conventional compressor. FIG. 8 is a plan view, illustrating an elastic member for use on the compressor. In FIGS. 7 and 8, a hermetic vessel 101 hermetically contains therein a compression element 102 and an electrically operated element 103. The compression element 102 includes a cylinder block 105 that forms a cylinder 104, a valve plate 106 for sealing the cylinder 104, an intake muffler 111, and a piston 113 reciprocated in the cylinder 104 by rotation of a shaft 112 that is secured to the electrically operated element 103. The intake muffler 111 is formed of resin, and has an end 107 positioned toward the cylinder and pressed against a gasket 110 through an irregularly deformed spring 109 around an intake orifice of the valve plate 106 by means of a thrust force of a cylinder head 108. The gasket 110 is disposed on a surface of the valve plate 106. The spring 109 has spring distal ends 114 positioned in respective concavities (not shown) of the intake muffler 111. The concavities (not shown) are provided in the intake muffler 111 at the end 107 thereof toward the cylinder. The cylinder head 108 contains the end 107 of the intake muffler 111, with the spring distal ends 114 being engaged with the intake muffler 111.

A description will now be made as to how the hermetic compressor as structured above (hereinafter called a compressor) operates.

A refrigerant gas returned to the compressor from a refrigerant cycle is released into the hermetic vessel 101. The refrigerant gas is then guided into the cylinder 104 after passing through the intake muffler 111 and the valve plate 106 that forms the compression element 102. In the cylinder 104, the piston 113 that is driven by the electrically operated element 103 through the shaft 112 compresses the refrigerant gas. The compressed refrigerant gas is again fed through the valve plate 106, and is then discharged into the refrigerant cycle without being released into the hermetic vessel 101.

At that time, pressure pulsing that results from intermittent compression caused by reciprocating motion of the piston 113 partially flows back to the intake muffler 111. However, the intake muffler 111 attenuates the pressure pulsing before the attenuated pressure pulsing is released into the hermetic vessel 101 because the gasket 110 impermeably seals the intake muffler 111 at the end 107 thereof toward the cylinder. As a result, noise can be reduced. The irregularly deformed spring 109 elastically fixes the intake muffler 111 to the cylinder head 108, thereby eliminating rattles of the intake muffler 111 which otherwise would occur when the reciprocating motion of the piston 113 vibrates the compression element 102. As a result, a highly reliable, low noise compressor is achievable.

Since the above-described conventional structure uses an irregularly deformed leaf spring as an elastic means, the leaf spring must be positioned in a proper direction during compressor assembly. In addition, the irregularly deformed leaf spring must be positioned within fine limits because the respective ends of the leaf spring must be received in the concavities of the intake muffler at the end thereof toward the cylinder. This causes a disadvantage of a reduction in productivity due to difficulties in positioning the leaf spring in the process of the compressor assembly. Another drawback to the above conventional structure is that the shape of the irregularly deformed leaf spring is too complicated to provide an inexpensive compressor.

DISCLOSURE OF THE INVENTION

In order to solve problems heretofore encountered, an object of the present invention is to provide an inexpensive, silently running hermetic compressor including a simply shaped leaf spring, which compressor is designed to provide smooth assembly without fine positioning of the leaf spring, and further to reliably press an orifice end of an intake muffler toward a cylinder against an intake port of a valve plate.

The present invention comprises: a compression element placed in a hermetic vessel; a cylinder block including a cylinder that forms the compression element; a valve plate including an intake port, the valve plate being disposed on the cylinder at an opening end thereof; a cylinder head rigidly secured to the valve plate opposite to the cylinder; an intake muffler having an outlet positioned in a concavity of the cylinder head, and further having an orifice of the outlet provided at a distal end of the intake muffler and opened to the intake port; and a substantially disk-like elastic member disposed between the outlet and the cylinder head, wherein the outlet orifice of the intake muffler constantly remains pressed against the intake port. Such a nearly disk-like shape of the elastic member provides an operation in which the elastic member can be readily attached without being positioned within fine limits irrespective of where the elastic member is oriented when the intake muffler is assembled onto the compressor. The semi-disk shape of the elastic member provides another operation that a simply shaped elastic member is available at an inexpensive price.

According to the present invention, the elastic member includes a substantially donut-like leaf spring loosely engaged with a protrusion that is provided on either a rear surface of the intake muffler at the outlet orifice of the intake muffler or an inner surface of the cylinder head at the concavity of the cylinder head. As a result, the elastic member can readily be attached between the rear surface of the intake muffler at the outlet orifice thereof and the inner surface of the cylinder head at the concavity thereof. This construction provides an operation in which the protrusion serves as a guide to provide efficient assembly without fine positioning of the elastic member.

According to the present invention, the leaf spring has a curvilinear surface. This configuration causes both a bending center of the leaf spring and ends of the leaf spring to always remain pressed against either the rear surface of the intake muffler at the orifice end of the intake muffler toward the cylinder or the inner surface of the cylinder head at the concavity of the cylinder head. This construction provides an operation in which assembly can be completed without fine positioning of the elastic means irrespective of where the elastic means is directed during compressor assembly.

According to the present invention, the leaf spring has peripheral portions bent toward the cylinder head, and ends of the leaf spring are held in linear contact with the cylinder head. This construction provides an operation in which the cylinder head is isolated from scoring and wear.

According to the present invention, the substantially disk-like elastic means is a waved elastic member bent in a direction of the circumference thereof, and an area of contact between the cylinder head and the intake muffler can be increased while a sufficient elastic force is retained. As a result, the cylinder head and the intake muffler are free from scoring and wear.

BRIEF DESCRIPTION OF THE DRAWINGS

The above objects and features of the present invention will become apparent in the following description of embodiments and the accompanying drawings in which.

BEST MODE FOR CARRYING OUT THE INVENTION

Figure 1:
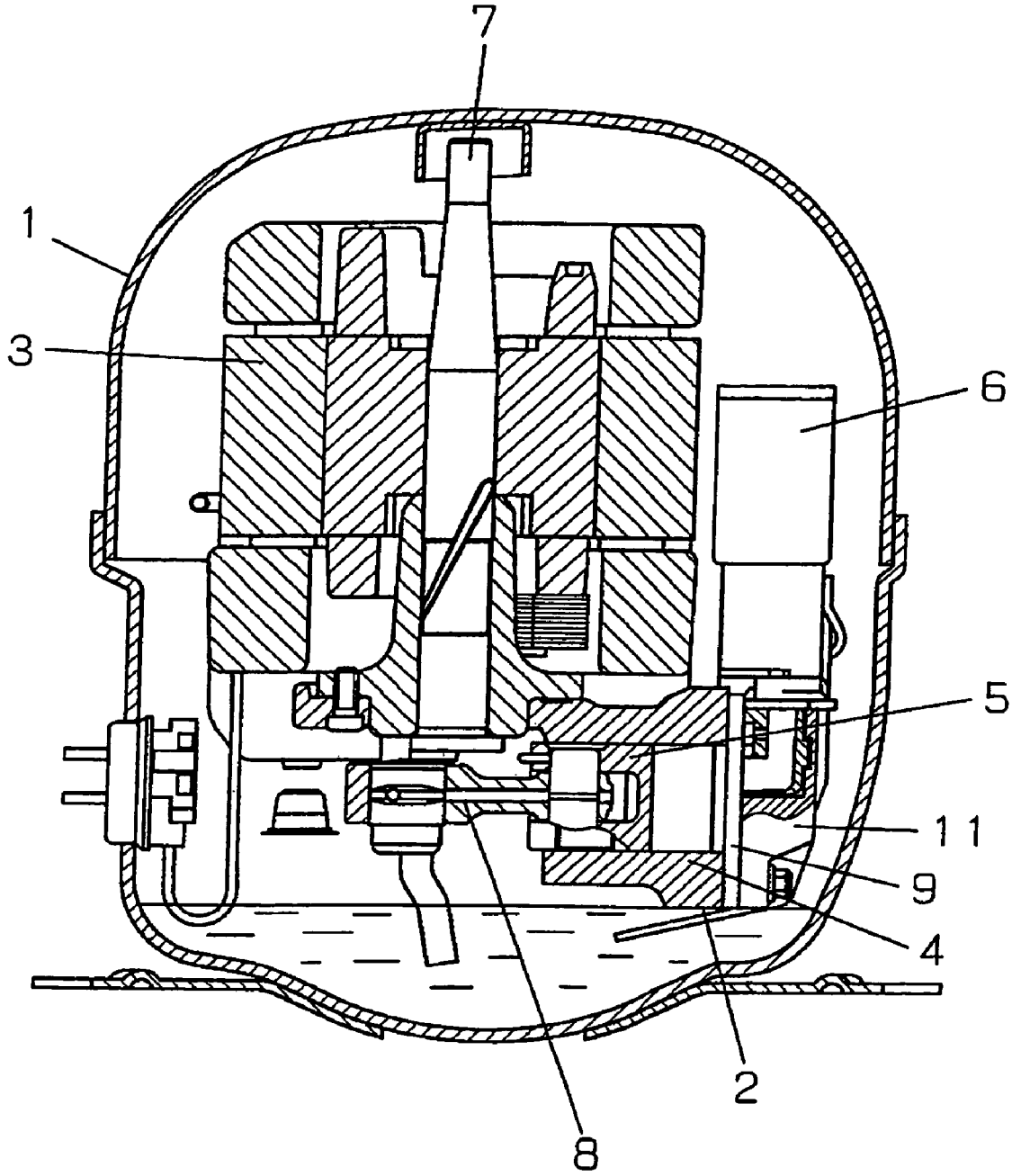
FIG. 1 is a longitudinal cross-sectional view, showing a hermetic compressor according to embodiment 1 of the present invention.

Embodiments of a hermetic compressor according to the present invention will now be described with reference to the drawings. The same component elements as those in the related art are identified by the same reference characters, and detailed descriptions thereof will herein be omitted.

(Embodiment 1)

Figure 2:
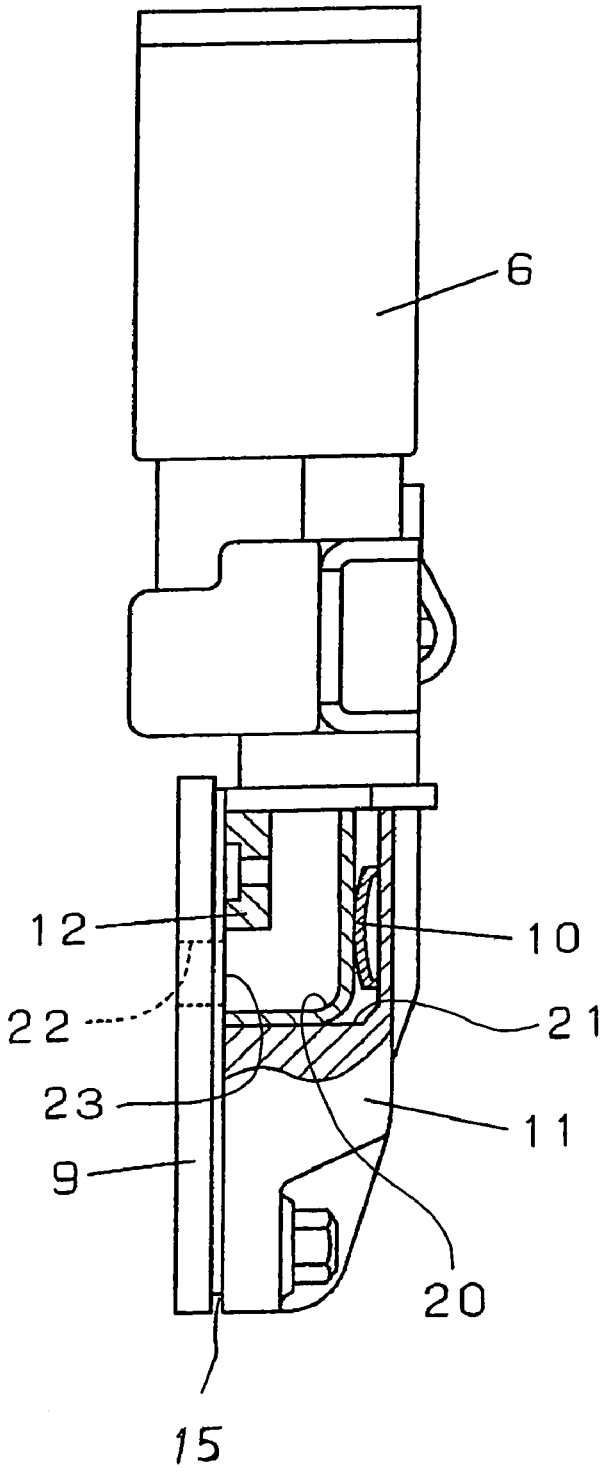
FIG. 2 is an enlarged, cross-sectional view, illustrating an essential portion of the compressor.

FIG. 1 is a cross-sectional view, illustrating an essential portion of a hermetic compressor according to embodiment 1. FIG. 2 is an enlarged view, illustrating respective essential portions of an intake muffler and a substantially disk-like leaf spring, which are used on the hermetic compressor.

In FIGS. 1 and 2, a hermetic vessel 1 contains therein a compression element 2 and an electrically actuated element 3 in a gas tight manner. The compression element 2 includes a shaft 7 rigidly secured to the electrically actuated element 3, a piston 5 reciprocated in a cylinder 4 by rotation of the shaft 7 through a connecting rod 8, a valve plate 9 for sealing the cylinder 4, and an intake muffler 6 elastically fixed to the valve plate 9 by means of an inner wall of the cylinder head 11 through a substantially disk-like leaf spring 10. The intake muffler 6 is preferably a synthetic resin material having a high adiabatic effect, such as PBT (Polybutylene Terephtalate) or PPS (Polyphenylene Sulfide), in view of a situation in which the intake muffler 6 is subjected to elevated temperature in a refrigerator oil atmosphere as well as a refrigerant gas. In view of a required shape, spring characteristics and cost, the leaf spring 10 is primarily made of either steel material for use as a spring or a cold-rolled steel band for use as a spring.

As shown in FIG. 2, the intake muffler 6 has an outlet 20 through which the refrigerant gas taken from the inside of the hermetic vessel 1 is lead to the cylinder 4. When assembling the intake muffler 6 with the cylinder head 11, this outlet 20 is telescopically inserted into a concavity 21 provided to the cylinder head 11. The outlet 20 of the intake muffler 6 has an orifice 23 which opens so that the refrigerant gas within the intake muffler 6 flows out to the side of an intake port 22. The orifice 23 opens facing the intake port 22, and is pressed by the intake port 22 thereby the refrigerant gas is lead from the orifice 23 to the inside of the cylinder via the intake port 22.

A description will now be made as to how the compressor as constructed above operates.

A refrigerant gas returned from a refrigerant cycle is released into the hermetic vessel 1. The refrigerant gas (not shown) is then guided into the cylinder 4 after passing through the intake muffler 6 and the valve plate 9 that forms the compression element 2. In the cylinder 4, the piston 5 that is driven by the electrically operated element 3 through the shaft 7 compresses the refrigerant gas. The compressed refrigerant gas is again fed through the valve plate 9, and is then discharged into the refrigerant cycle without being released into the hermetic vessel 1.

At this time, pressure pulsing that results from intermittent compression caused by reciprocating motion of the piston 5 partially flows back to the intake muffler 6. However, the intake muffler 6 attenuates the pressure pulsing before the attenuated pressure pulsing is released into the hermetic vessel 1 because a gasket 15 impermeably seals an end 12 of the intake muffler 6 toward the cylinder. As a result, reduced noise is attainable. In addition, the substantially disk-like spring 10 elastically fixes the muffler 6 to the cylinder head 11, thereby eliminating rattles of the intake muffler 6, which otherwise would occur when the reciprocating motion of the piston 5 vibrates the compression element 2. As a result, problems such as the occurrence of wear and that of noise due to the rattles can be obviated.

Furthermore, the leaf spring 10 forms a substantially disk shape that ignores directionality of the leaf spring 10 during assembly of the cylinder head 11. This feature eliminates laborious operations that involve a great deal of effort, such as fine positioning of the leaf spring 10 and an operation to have the leaf spring 10 oriented in a proper direction. As a result, improved productivity is achievable.

(Embodiment 2)

Figure 3:
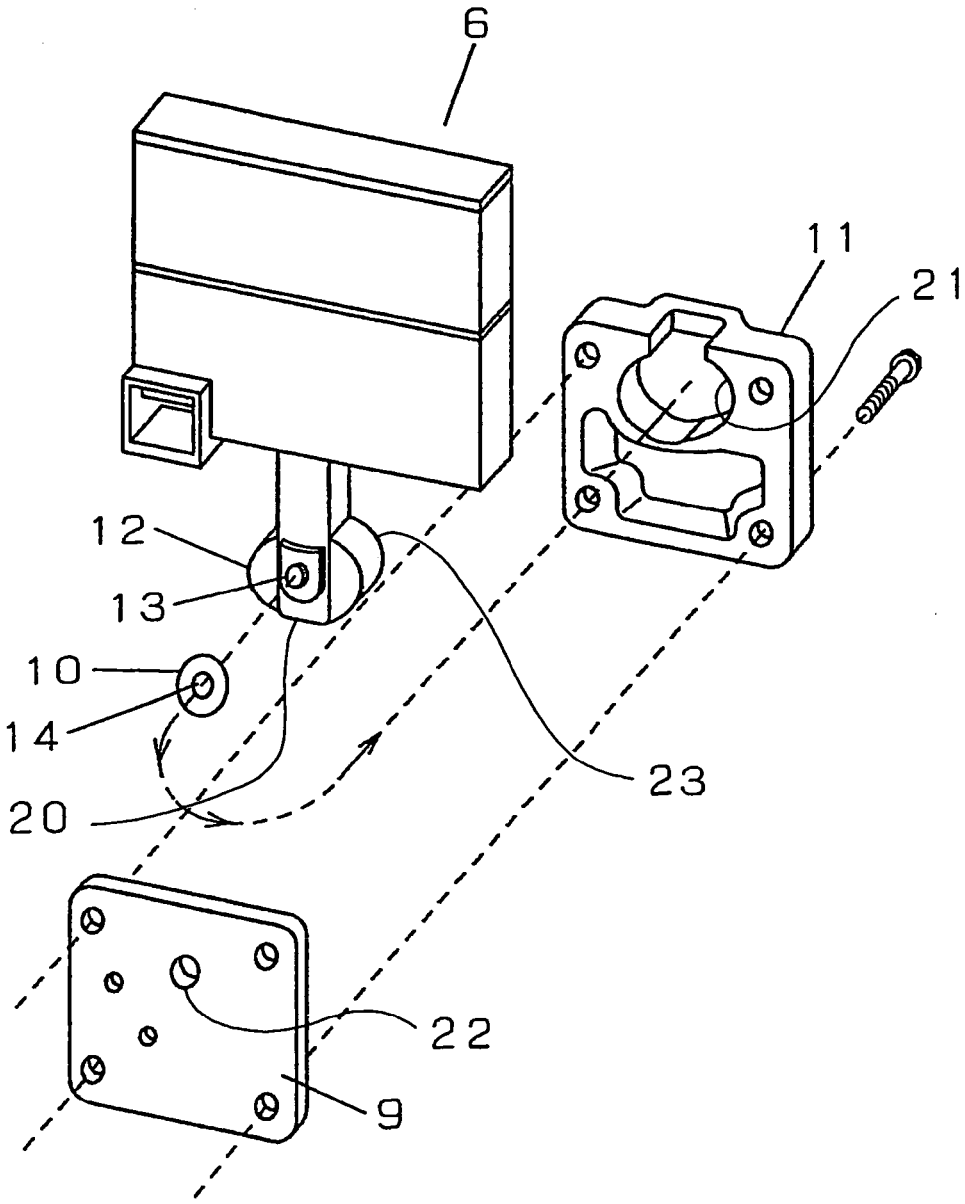
FIG. 3 is an exploded perspective view, illustrating an intake muffler and a substantially disk-like leaf spring according to embodiment 2.

FIG. 3 is an exploded perspective view of an intake muffler 6 and a substantially disk-like leaf spring which are used in a hermetic compressor according to embodiment 2. In FIG. 3, reference numeral 13 denotes a protrusion provided on the intake muffler 6 at the end 12 toward the cylinder. The protrusion 13 is loosely engaged with a lightening hole 14 of the leaf spring 10. The cylinder head 11 presses the end 12 of the muffler 6 against the gasket 15 through the leaf spring 10, thereby elastically fixing the end 12 to the gasket 15. In FIG. 3, the protrusion 13 is disposed on the muffler 6 at the end 12 toward the cylinder, but may alternatively be provided on an internal surface of the cylinder head 11.

The leaf spring 10 elastically fixes the intake muffler 6 to the cylinder head 11, and thus eliminates rattles of the intake muffler 6 which otherwise would occur when reciprocating motion of the piston 5 vibrates the compression element 2. As a result, problems such as the occurrence of wear and that of noise due to the rattles can be avoided.

In addition, the leaf spring 10 has a nearly disk shape that neglects directionality of the leaf spring 10 during assembly of the cylinder head 11. This feature eliminates laborious operations such as fine positioning of the leaf spring 10 and an operation to have the leaf spring 10 directed in a proper direction, and thus provides improved productivity.

Figure 4:
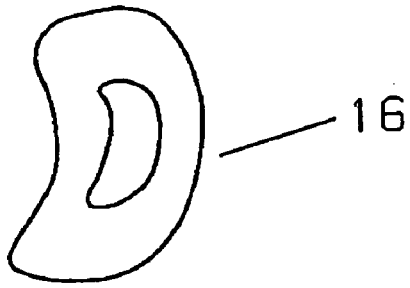
FIG. 4 is an enlarged perspective view, illustrating a leaf spring according to embodiment 2.
Figure 5:
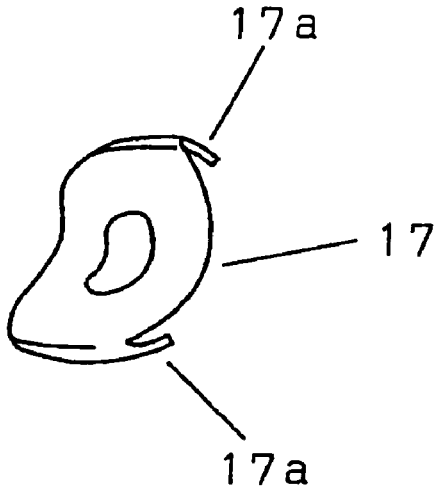
FIG. 5 is an enlarged perspective view, illustrating another leaf spring according to embodiment 2.
Figure 6:
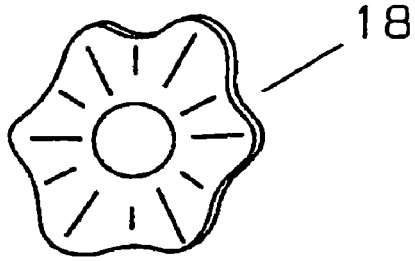
FIG. 6 is an enlarged perspective view, illustrating a further leaf spring according to embodiment 2.
Figure 7:
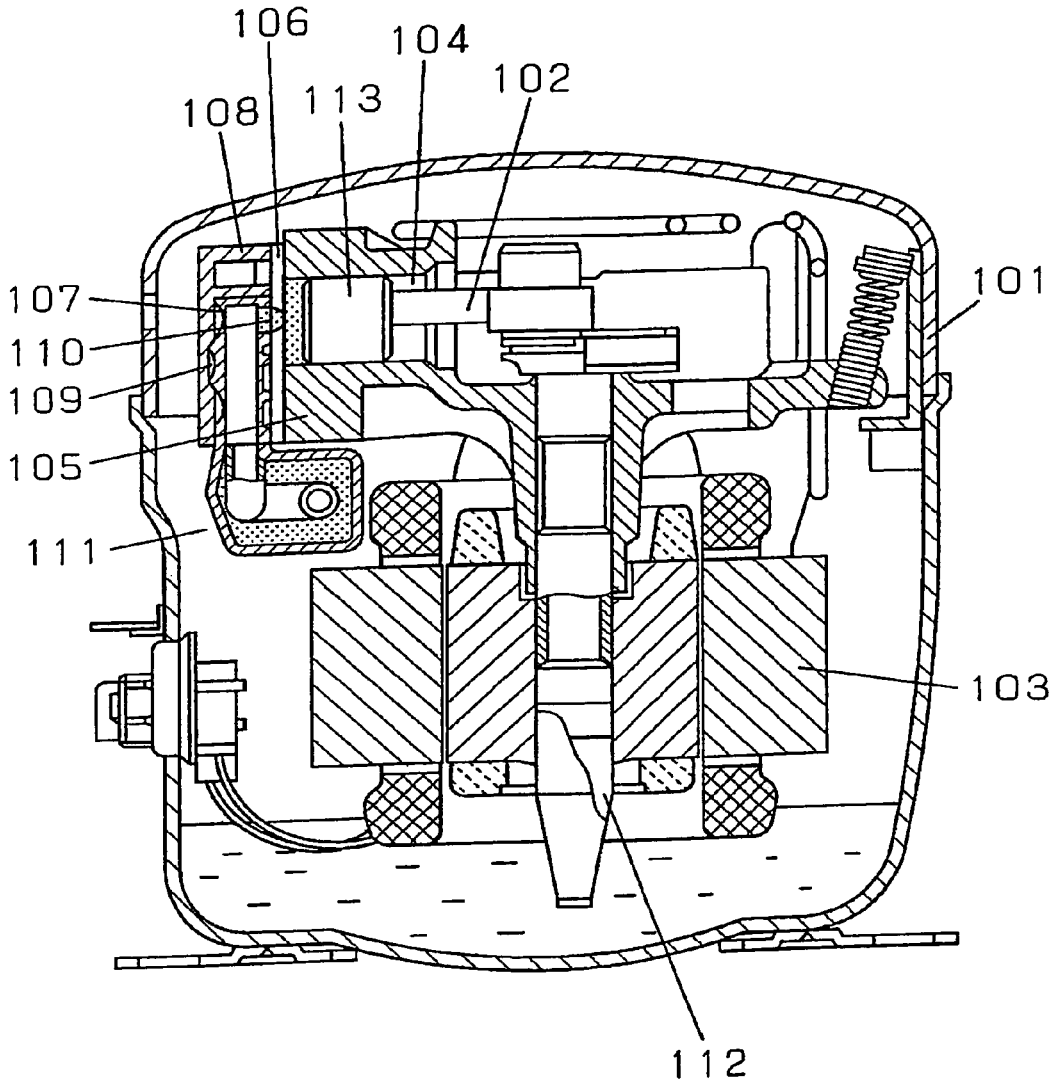
FIG. 7 PRIOR ART
FIG. 7 is a longitudinal cross-sectional view, illustrating a prior art hermetic compressor.
Figure 8:
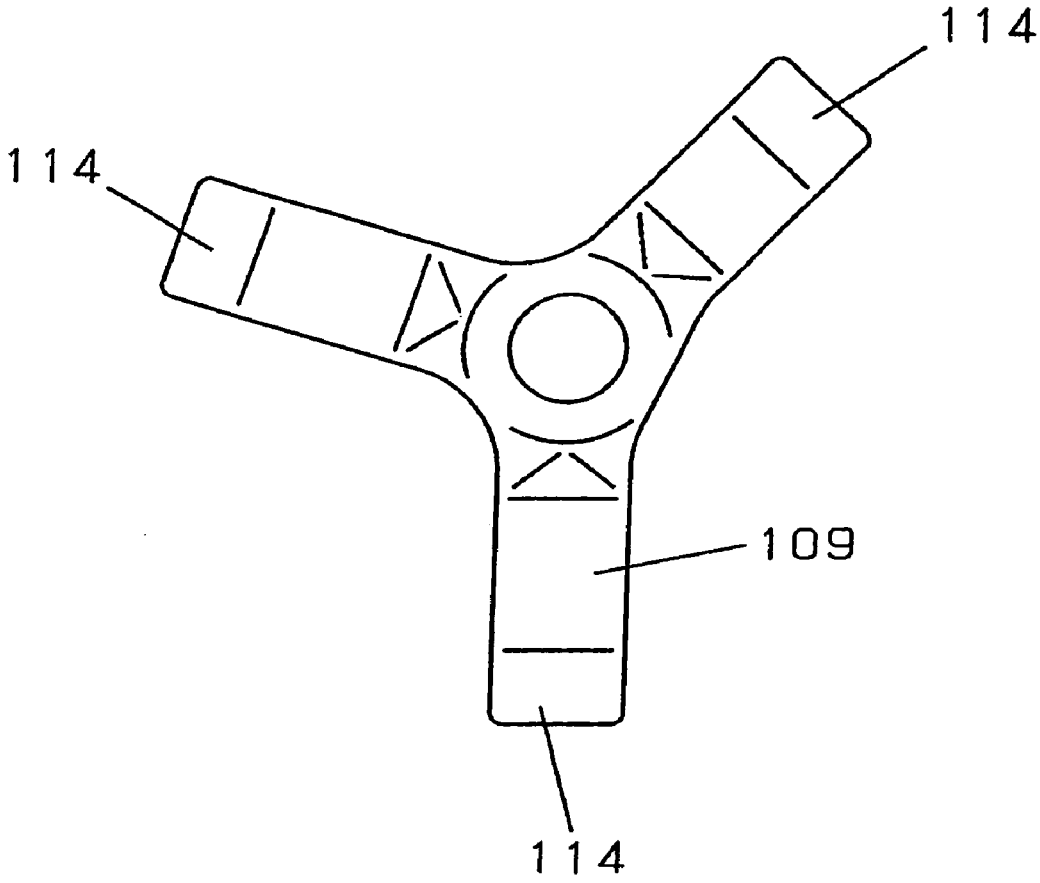
FIG. 8 PRIOR ART
FIG. 8 is a plan view, showing an elastic member used on the prior art compressor.

Although the elastic member according to embodiment 2 is used as a nearly donut-like leaf spring, different elastic members shaped as illustrated in FIGS. 4, 5, and 6 provide similar effects. Elements which are the same as or corresponding to those elements in the embodiment 1 are designated by the same reference numerals, and the description thereof is omitted.

FIG. 4 is an enlarged perspective view of another leaf spring according to embodiment 2. In FIG. 4, reference numeral 16 denotes a leaf spring having a curvilinear surface. Such a leaf spring shape allows for compressor assembly regardless of where the leaf spring is oriented.

FIG. 5 is an enlarged perspective view of a further leaf spring according to embodiment 2. In FIG. 5, reference numeral 17 denotes a leaf spring having peripheral portions 17*a* bent toward the cylinder head. As a result, ends of the leaf spring 17 are held in linear contact with the cylinder, thereby isolating the cylinder head from scoring and wear.

FIG. 5 is an enlarged perspective view of a further leaf spring according to embodiment 2. In FIG. 5, reference numeral 17 denotes a leaf spring having peripheral portions 17*a* bent toward the cylinder head. As a result, ends of the leaf spring 17 are held in linear contact with the cylinder head, thereby isolating the cylinder head from scoring and wear.

INDUSTRIAL APPLICABILITY

As discussed above, the present invention comprises: a compression element placed in a hermetic vessel; a cylinder block including a cylinder that forms the compression element; a valve plate including an intake port, the valve plate being disposed on the cylinder at an opening end thereof; a cylinder head rigidly secured to the valve plate opposite to the cylinder; an intake muffler having an outlet positioned in the cylinder head at a concavity thereof, and further having an orifice of the outlet provided at a distal end of the intake muffler and opened to the intake port; and a substantially disk-like elastic member disposed between the outlet and the cylinder head, wherein the outlet orifice of the intake muffler always remains pressed against the intake port. As a result, the intake muffler can elastically be fixed without being rattled. This feature makes it feasible to provide a low noise, low cost compressor with improved productivity.

According to the present invention, the elastic member includes a substantially donut-like leaf spring loosely engaged with a protrusion that is provided on either a rear surface of the intake muffler at the outlet orifice of the intake muffler or an inner surface of the cylinder head at the concavity of the cylinder head. This configuration makes it possible to provide further improved productivity, and thus provides a low cost compressor.

According to the present invention, the leaf spring is provided with a curvilinear surface. This configuration causes both a bending center of the leaf spring and ends of the leaf spring to always remain pressed against either the rear surface of the intake muffler at the orifice end of the intake muffler toward the cylinder or the inner surface of the cylinder head at the concavity of the cylinder head. Consequently, required spring characteristics are achievable in a stable manner, even with a small leaf spring. As a result, the leaf spring is usable on a small-sized compressor such as a refrigerator-dedicated compressor that is designed for use in a highly limited accommodation space.

According to the present invention, the leaf spring has peripheral portions bent toward the cylinder head, and ends of the leaf spring are held in linear contact with the cylinder head. As a result, a longer life compressor having wear-resistant contact portions is available at low cost.

According to the present invention, the substantially disk-like elastic means is a serrated leaf spring circumferentially bent in a sinusoidal fashion. As a result, a longer life compressor having wear-resistant contact portions is available, in which an area of contact between the cylinder head and the intake muffler can be increased while a sufficient elastic force is retained.

What is claimed is:

1. A hermetic compressor comprising:

a hermetic vessel;

a compression element placed in the hermetic vessel;

a cylinder block including a cylinder that forms the compression element;

a valve plate including an intake port, the valve plate being disposed on an opening end of the cylinder;

a cylinder head rigidly secured to the valve plate opposite to the cylinder; an intake muffler having an outlet positioned in a concavity of the cylinder head, and further having an orifice of the outlet provided at a distal end of the intake muffler and opened to the intake port; and a substantially disk-like elastic member disposed between the outlet and the cylinder head, wherein said orifice of the outlet of the intake muffler constantly remains pressed against the intake port.

2. A hermetic compressor as defined in claim 1, wherein the elastic member includes a substantially donut-like leaf spring loosely engaged with a protrusion that is provided on either one of a rear surface of the intake muffler at the outlet orifice thereof and an inner surface of the cylinder head at the concavity thereof.

3. A hermetic compressor as defined in claim 1 or 2, wherein the leaf spring has a curvilinear surface.

4. A hermetic compressor as defined in claim 3, wherein the leaf spring has peripheral portions bent toward the cylinder head.

5. A hermetic compressor as defined in claim 1, wherein the leaf spring is a waved leaf spring which is bent in a direction of the circumference thereof.

* * * * *